US010195101B1

(12) United States Patent
Novak

(10) Patent No.: US 10,195,101 B1
(45) Date of Patent: Feb. 5, 2019

(54) METHOD AND APPARATUS FOR PREVENTING HAIR LOSS

(71) Applicant: Caleb C. Novak, Chicago, IL (US)

(72) Inventor: Caleb C. Novak, Chicago, IL (US)

( * ) Notice: Subject to any disclaimer, the term of this patent is extended or adjusted under 35 U.S.C. 154(b) by 703 days.

(21) Appl. No.: 14/639,809

(22) Filed: Mar. 5, 2015

(51) Int. Cl.
*A61H 7/00* (2006.01)

(52) U.S. Cl.
CPC ..... *A61H 7/006* (2013.01); *A61H 2201/1604* (2013.01)

(58) Field of Classification Search
CPC ..... A61H 7/006; A61H 35/008; A61H 2201/1604
See application file for complete search history.

(56) References Cited

U.S. PATENT DOCUMENTS 1,523,979 A * 1/1925 Ryan ..... A61H 7/006 2/174
2,210,858 A * 8/1940 Loeber ..... A61H 7/006 601/136
2,280,624 A * 4/1942 Buckley ..... A61H 7/006 601/136
2,467,007 A * 4/1949 Frederick ..... A61H 7/006 123/195 A
4,469,092 A 9/1984 Marshall et al.
4,765,316 A 8/1988 Marshall
5,081,986 A * 1/1992 In ..... A61H 7/006 601/144
5,140,978 A 8/1992 Sirninger
5,572,746 A * 11/1996 Linico ..... A42B 7/00 2/182.1
6,228,041 B1 5/2001 Ameer
8,530,484 B2 9/2013 Akridge
8,985,123 B2 * 3/2015 Green ..... A46B 9/023 132/130

* cited by examiner

*Primary Examiner* — Steven Douglas
(74) *Attorney, Agent, or Firm* — Cook Alex Ltd.

(57) ABSTRACT

A cap for preventing hair loss has a crown with protrusions extending from the concave surface of the crown. When the cap is placed on a user's skull at least one of the protrusions is aligned with a suture in the skull. Rubbing on the exterior of the crown at the locations of the protrusion will abrade excess bone growth or thickening on top of the suture thereby assuring circulation to the scalp to support hair growth.

12 Claims, 6 Drawing Sheets

METHOD AND APPARATUS FOR PREVENTING HAIR LOSS

FIELD OF THE DISCLOSURE

The present disclosure is directed to a method and apparatus for preventing alopecia or hair loss and for restoring hair.

BACKGROUND

Hair loss, while not life-threatening condition, can be a life-altering condition in terms of negative social and psychological effects. Millions of people are affected. Some of those affected by hair loss treat it as an inevitable, untreatable result of an unfortunate genetic makeup and soldier on as if nothing can be done to prevent it or reverse it once it sets in. Others are unwilling to accept hair loss as their "fate" and have sought to counteract their hair loss through any available means. This has spawned a multi-billion dollar industry that has responded with a dizzying array of treatments that range from sheer quackery to somewhat effective for some. Treatments seemingly are limited only by a patient's willingness to spend resources in hopes of finding something that works. There are creams and sprays and pills. Surgical procedures such as transplants can be effective when performed skillfully but anything short of that can result in a "doll head" complexion. In any event, surgical procedures are painful, expensive and time consuming. Two products approved by the FDA have shown some results (finasteride and minoxidil). However, these treatments do not work for all users and the benefits wane if treatment is ceased. Thus, the need for an effective, simple hair loss treatment continues.

SUMMARY

I have discovered that the root of the problem lies not with the ability of the skin to grow hair. Rather the problem is literally underlying the skin. It is skull growth or thickening that takes place along or near skull suture lines and cuts off circulation to hair follicles. When bone growth or thickening on top of the skull at the suture lines takes place it pushes against the underside of the skin which decreases the blood flow in the skin and reduces the supply of nutrients needed for hair growth.

In one aspect, the present disclosure is directed to removal of the skull suture growth or thickening by gentle abrasion of it by rubbing the skin in the correct locations to remove the growth or thickening. A patient can accomplish this on his or her own by using the fingers to rub on the skin. In my own experience rubbing along the suture lines for about an hour a day has produced successful results, although shorter durations of daily rubbing will also have beneficial effects. When rubbing for a long time, the lymph notes can feel painful, almost as if the nodes are digesting the secretion being rubbed away.

A patient who diligently feels his or her scalp for the suture lines can train himself or herself to find the affected lines and treat them appropriately. However, it is recognized that not all patients will have the requisite patience to self-determine where the lines of excess bone growth or thickening are occurring. Accordingly, the present invention provides a head covering or cap or mold with semi-rigid or firm protrusions formed on its inner or concave surface. These protrusions are aligned with the skull sutures. The protrusions are readily discernable through the crown of the cap. The user then will rub on the protrusions to create the abrasion on the skull necessary to remove excess suture growth or thickening. As mentioned above, removal of suture growth or thickening on the outer surface of the skull will improve blood flow to the scalp, resulting in prevention of hair loss and regeneration of the hair cycle.

DETAILED DESCRIPTION OF THE EMBODIMENTS

Figure 2:
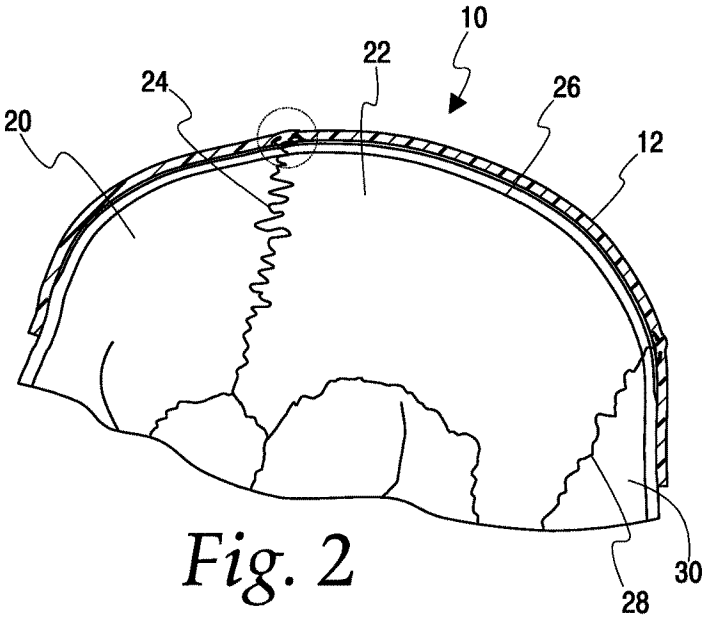
FIG. 2 is a schematic side elevation view of a skull, showing some skull sutures and a section of the cap.
Figure 1:
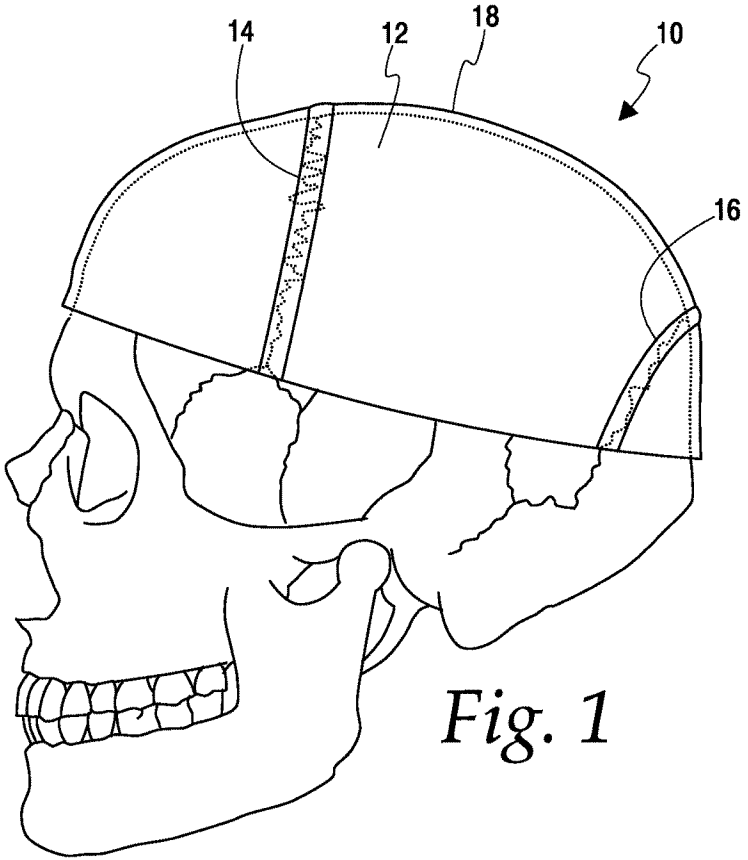
FIG. 1 is a schematic side elevation view of the cap of the present invention in place on a human skull, with some of the lateral sutures shown schematically through the cap.
Figure 3:
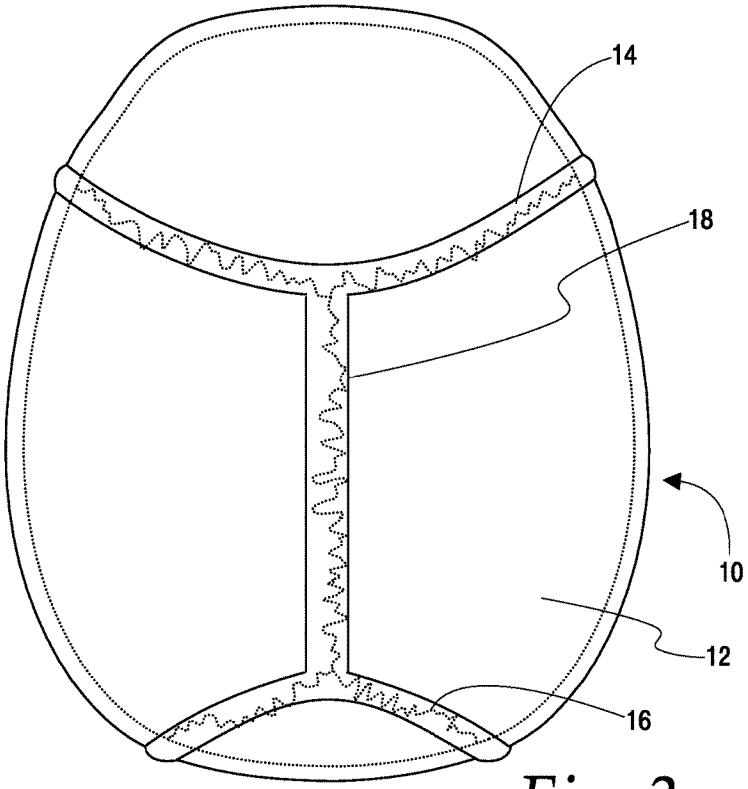
FIG. 3 is a top plan view of the cap.

FIGS. 1-3 show one embodiment of a cap 10 according to the present invention. It is pointed out that as used herein the term 'cap' is not limited to a device that grips the skull. While the cap may be large enough to grip the skull, the cap of the present disclosure need only overlap a portion of the skull. The cap has a rounded crown 12. The crown could be made of a variety of materials. For example, a relatively soft crown could be made of a suitable fabric such as cotton or polyester. Alternately, the crown could be a molded structure. On the inner or concave side of the crown there are one or more protrusions. The protrusions are located on the crown such that when the crown is placed on a user's skull the protrusions will be aligned with the sutures or related features of the skull. In this embodiment the cap has a coronal protrusion 14, a lambdoid protrusion 16 and a sagittal protrusion 18 connecting the coronal and lambdoid protrusions. The sagittal protrusion 18 is best seen in FIG. 3.

The skull sutures themselves are best seen in FIG. 2. Adjoining the frontal bone 20 and parietal bone 22 is the coronal suture 24. The parietal bones have the sagittal suture 26. It terminates at the lambdoid suture 28. The lambdoid suture 28 joins the parietal bone 22 to the occipital bone 30.

The crown 12 of the cap 10 is placed so as to rest comfortably on the user's skull. When correctly placed there will be no tendency of the cap to fall off the back or sides of the head. Likewise, there will be no tendency of the cap to cover the eyes. In this correct location of the cap the coronal protrusion 14, lambdoid protrusion 16 and sagittal protrusion 18 will be aligned with the coronal suture 24, the lambdoid suture 28 and the sagittal suture 26, respectively. That is, the protrusions will overlie their respective sutures. When so located the protrusions serve as guides for the user to rub on the exterior of the crown where the protrusions are located. This will have the effect of abrading or wearing away the bone growth or thickening on the exterior surface of the skull in the locations of the sutures.

Figure 4:
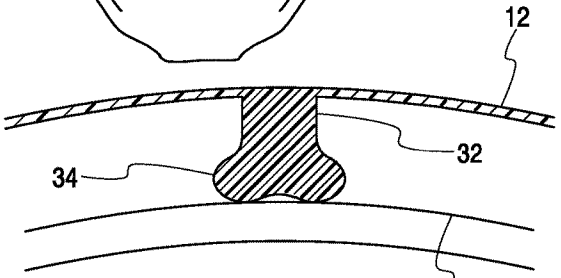
FIG. 4 is a section through one embodiment of a protrusion, on an enlarged scale.
Figure 9:
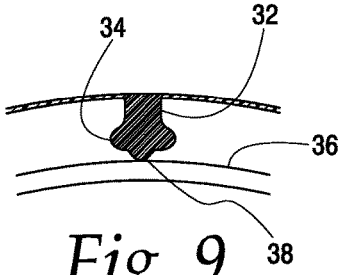
FIG. 9 is a section through an alternate embodiment of a protrusion.

FIG. 4 illustrates a cross-section of a protrusion. It has a post 32 connected at one end to the crown 12. The other end of the post joins an engagement portion 34 of broadened cross-section. The engagement portion 34 is in contact with the scalp 36. FIG. 9 shows an alternate embodiment of the protrusion. It is similar to the embodiment of FIG. 4 but adds a somewhat pointed tip 38. The tip 38 provides a more concentrated effect of the rubbing. In either case the protrusion may be made of a firm but semi-rigid material such as hardened rubber. Other materials could be used so long as they provide a noticeable tactile feedback to the user as to where he or she should apply the fingers for rubbing the scalp.

Figure 6:
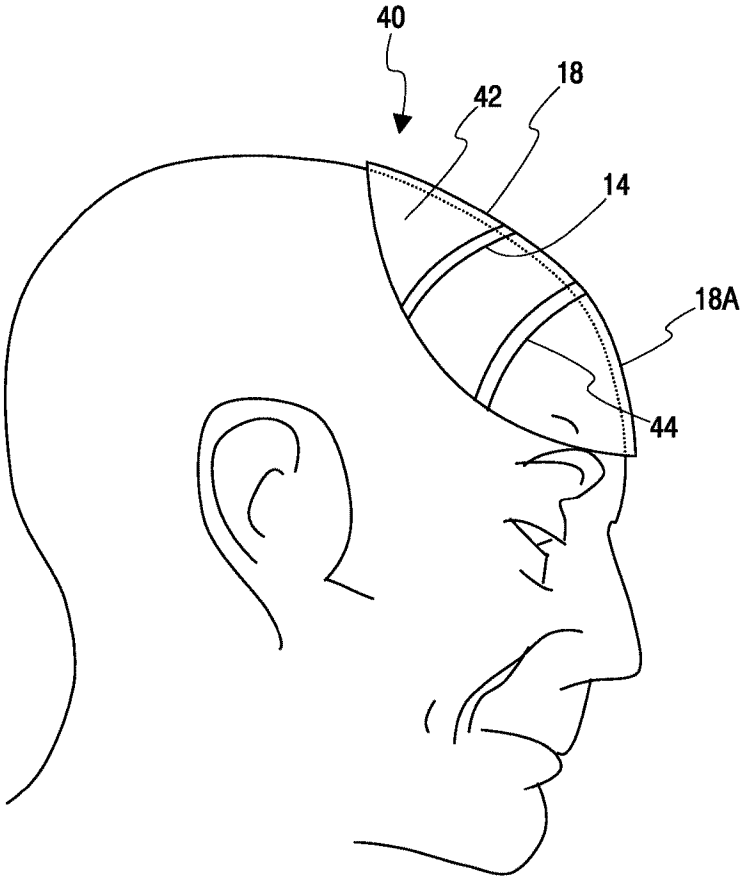
FIG. 6 is a side elevation view of a further alternate embodiment of a cap of in place on a user.
Figure 7:
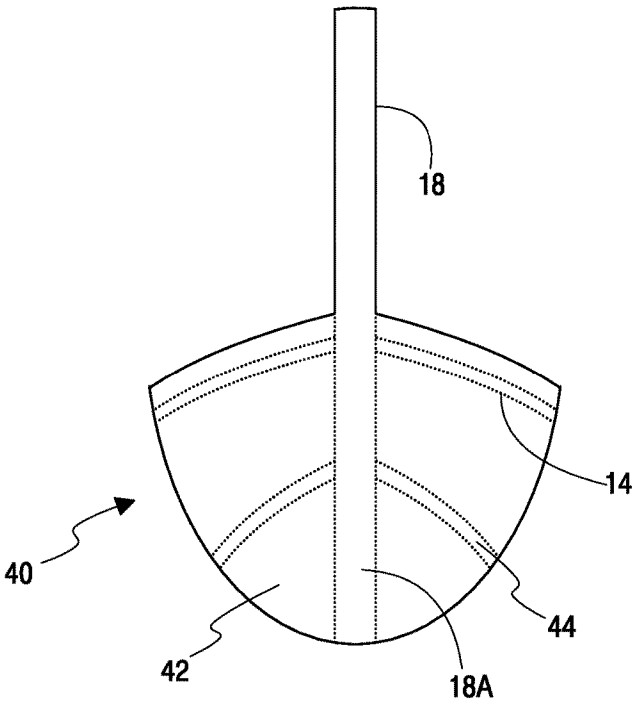
FIG. 7 is a plan view of the cap of FIG. 6.

FIGS. 6-7 illustrate an alternate embodiment. In this embodiment the cap 40 has a reduced crown 42 as compared to the previous embodiment. This could be used by experienced patients who know where to place the cap and don't need the locating assist provided by the full crown. This version has a coronal protrusion 14 as before. It also has a sagittal protrusion 18 but in this instance there is an extension 18A of the sagittal protrusion to the front of the crown 42. There is also a laterally-extending, forehead protrusion 44 located about midway between the coronal suture 24 and a line joining the tops of the orbital surfaces (the eye sockets) of the front bone 20. Although there are no sutures at the locations of the extension 18A and forehead protrusion 44, it has been found beneficial to rub the skull along the lines shown to minimize a receding hair line.

Figure 8:
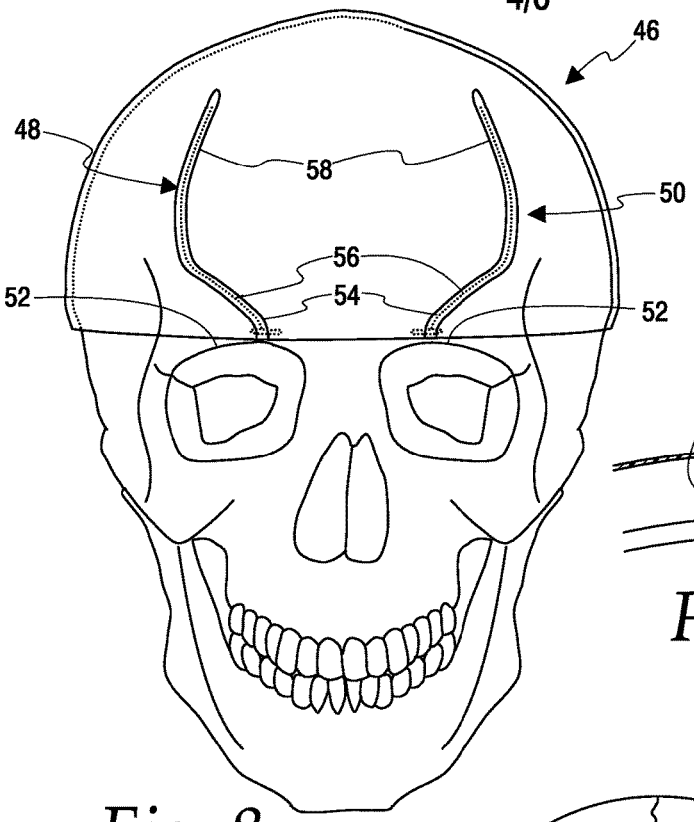
FIG. 8 is a front elevation view of a further alternate embodiment of the cap.

FIG. 8 illustrates yet another embodiment of the cap at 46. Cap 46 may be similar to cap 10 with the addition of two generally longitudinal forehead protrusions 48 and 50. These start at the supraorbital foramen or notch 52, go up briefly at 54 and then slope laterally at 56 before extending toward the rear of the front bone at 58.

Figure 5:
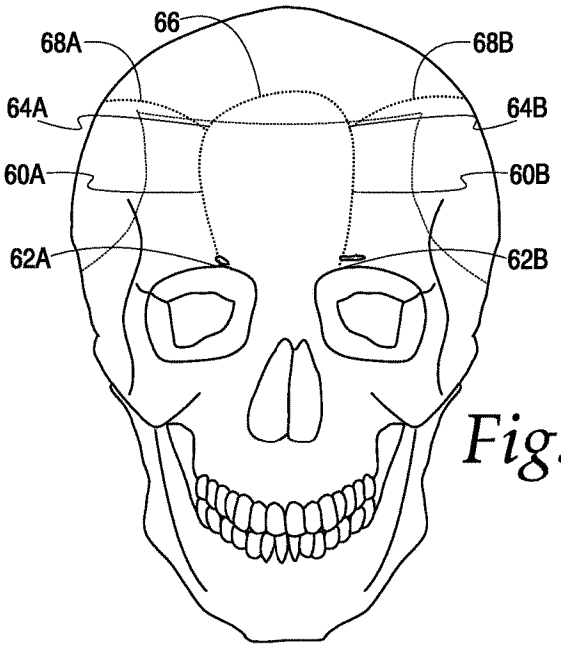
FIG. 5 is a front elevation view of a skull schematically showing the lines or locations of the protrusions of an alternate embodiment of the cap.

FIG. 5 illustrates additional lines along which protrusions on a cap could be aligned. It will be understood that this figure does not show the cap or protrusions themselves. Rather, it illustrates the locations on a skull where protrusions would be beneficial. The lines 60A and 60B are one inch (plus or minus a centimeter) on either side of a centerline that extends forwardly from the sagittal suture 26. Lines 60A, 60B extend from the supraorbital foramen 62A, 62B four inches up and toward the rear to a junction 64A, 64B. The two junction points 64A, 64B are joined by a joining arc 66 which has about a one inch radius. In addition, there are rearwardly extending lines 68A, 68B which extend from the junction points 64A, 64B, respectively, toward the coronal suture 24. Lines 68A, 68B are substantially mirror images of the joining arc 66, pivoted about the junction points.

Figure 10:
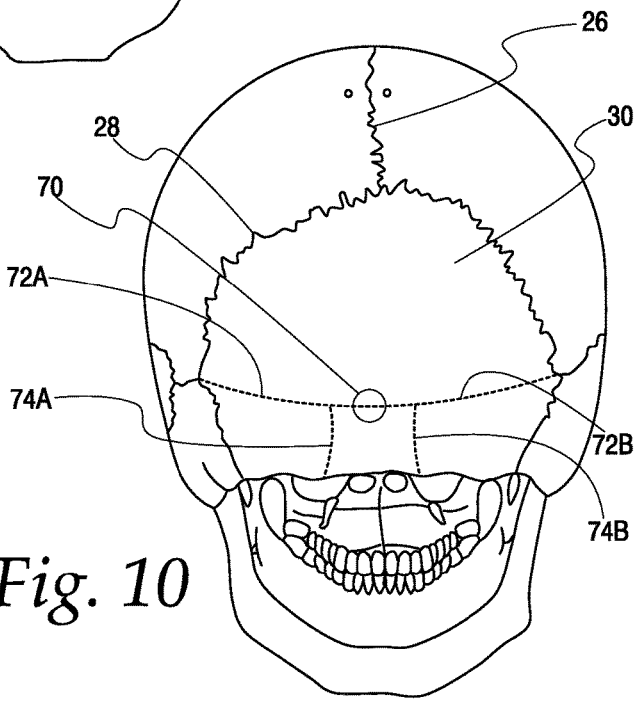
FIG. 10 is a rear elevation view of another alternate embodiment of the cap.

FIG. 10 is similar to FIG. 5 in that it illustrates some additional lines along which cap protrusions would be beneficial. These lines extend from the occipital protuberance 70. They include horizontal lines 72A, 72B which extend from the occipital protuberance 70 horizontally toward a point where they connect with the lambdoid suture 28. In addition, there are two vertical lines 74A, 74B that join the vertical lines 72A, 72B, respectively, about a half inch on either side of the occipital protuberance. Vertical lines 74A, 74B extend down to the base of the skull.

Figure 12:
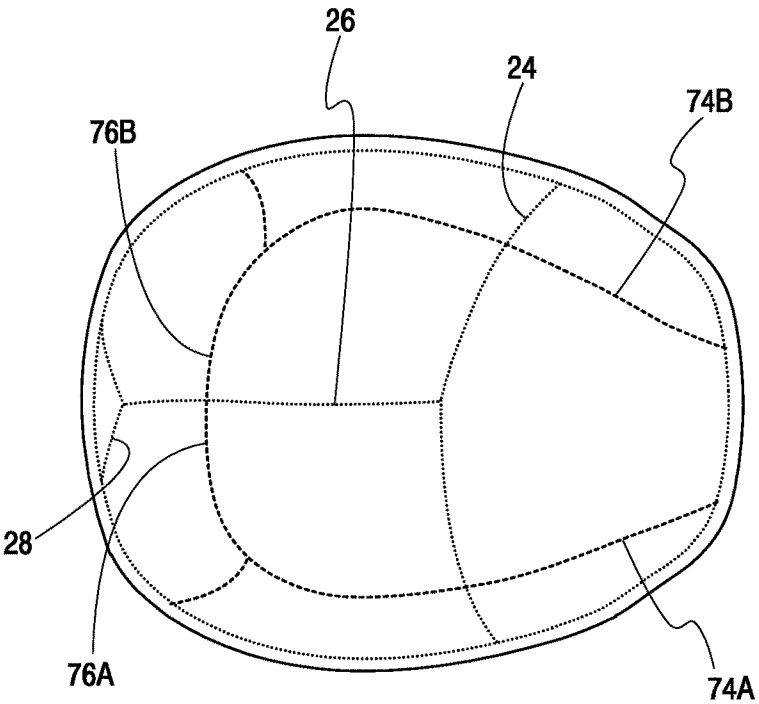
FIG. 12 is a top plan view of the cap of FIG. 11.
Figure 11:
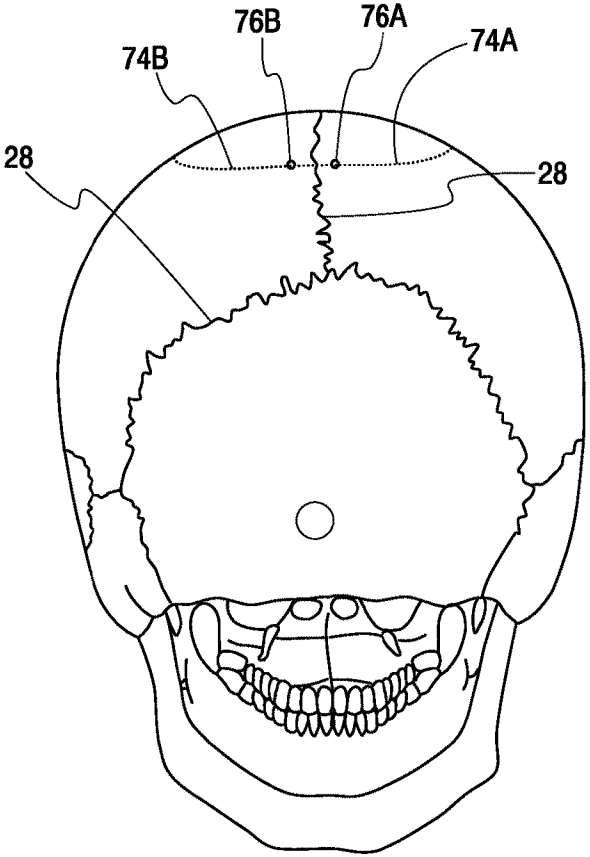
FIG. 11 is a rear elevation view of a skull schematically showing the lines or locations of the protrusions of another alternate embodiment of the cap.
Figure 13:
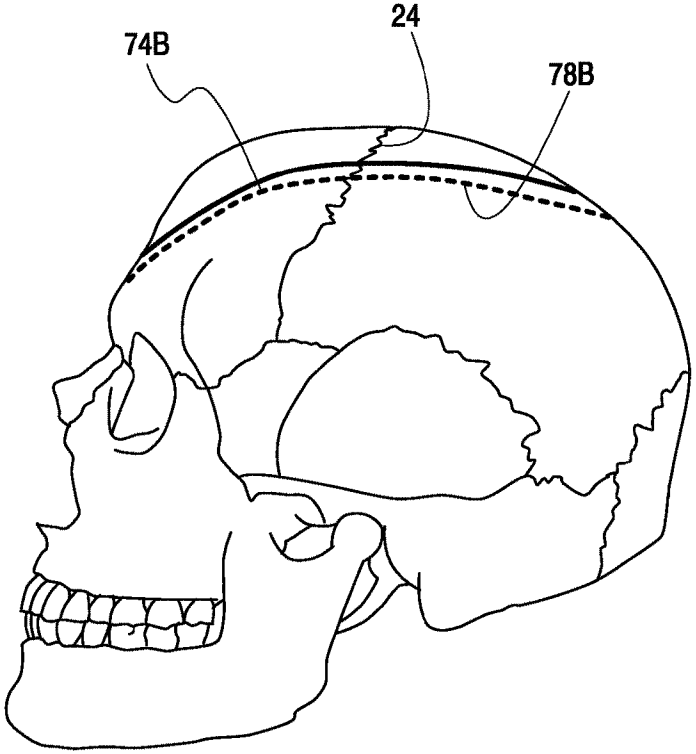
FIG. 13 is a side elevation view of the cap of FIG. 11.

FIGS. 11-13 also illustrate some additional lines along which cap protrusions would be beneficial. This is a modification of the cap shown in FIG. 8 in that lines 74A, 74B start at the supraorbital foramen 62A, 64B, and extend toward the rear. The lines extend beyond the coronal suture 24 and connect to the parietal foramen 76A, 76B. Lines 74A, 74B traverse much of the skull, about one inch from the inferior temporal lines (78B in FIG. 13) on each side.

Figure 14:
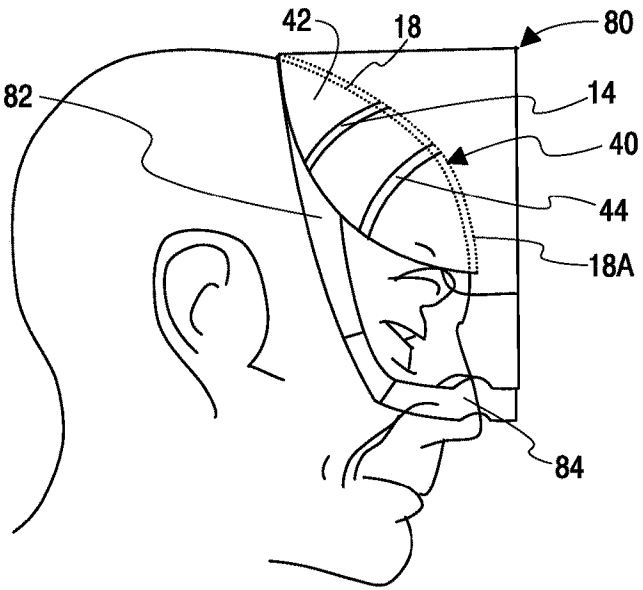
FIG. 14 is a side elevation view of a further alternate embodiment in place on a user.

FIG. 14 shows a modification of the cap 40 of FIGS. 6 and 7. This variation adds a box-like frame 80 to the cap. A pair of straps (one of which is visible at 82) extend from the sides of the frame 80. The straps are connected by a cheek bone and nose bridge 84. The frame 80 is rigid enough to support the user's head on a flat surface such as a table or desk top, a door, a wall or the like. The user can press his head against the flat surface and gently rock back and forth and/or side to side. This motion will cause the protrusions on the cap to effect the desired abrasion at the lines defined by the cap protrusions.

Figure 15:
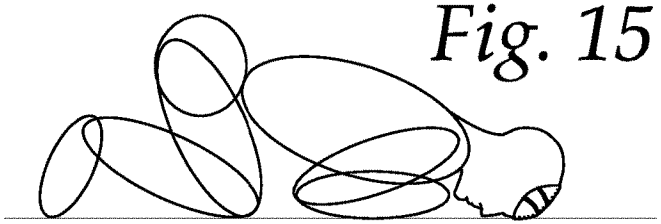
FIG. 15 is a schematic side elevation view of the embodiment of FIG. 14 wherein a user will be partially upside down at a 45 degree angle to a surface such as a table or floor.

FIG. 15 illustrates an alternate method of using the cap of FIGS. 6 and 7. In this approach the user is somewhat upside down such that the user's torso is at about a 45 degree angle to a surface such as a table or floor. The cap is between the user's skull and the surface. Gently rocking back and forth and side to side will effect the desired abrading at the suture lines.

It should be understood that various changes and modifications to the presently preferred embodiments described herein will be apparent to those skilled in the art. Such changes and modification can be made without departing from the spirit and scope of the invention disclosed herein. For example, while the coronal, sagittal and lambdoid protrusions are shown, these could be used in some other combination of protrusions. Some users may decide the sagittal suture, being right in the middle of the top of their skull is simple enough to find without the aid of a protrusion. For such users the sagittal protrusions may not be necessary. Another alternative involves a somewhat invasive approach in which nanotechnology, or "nano bots", are implanted under the skin, yet above the bone along the sutures in question, in order to brace the skull to maintain it's natal shape. The appearance can be as tiny as the metal strip found in a twenty dollar bill, to the entire width of the suture itself. Another alternative embodiment would save the user having to create his own rubbing action by building such action into the protrusions in the cap. That is, a vibratory action on the protrusions could be imparted in a manner similar to standard vibrators. Or the protrusions could be replaced by an irregularly shaped elongated member, in the nature of a string of beads or a bicycle chain. An oscillatory motion imparted to the elongated member along its length could provide the necessary rubbing action.

The invention claimed is:

1. A cap comprising a crown having a concave surface, the cap further comprising at least one protrusion attached to the concave surface of the crown and extending inwardly from the concave surface, the at least one protrusion being located such that when the cap is placed on a user's skull the at least one protrusion is configured to be aligned with a suture on the user's skull while all portions of the concave surface remote from a suture are free of anything extending from the concave surface wherein the suture is at least one of a coronal suture, a sagittal suture and a lambdoid suture.

2. The cap of claim 1 wherein the crown is sized to substantially cover the frontal and parietal bones of the skull.

3. The cap of claim 1 wherein the crown is sized to substantially cover the frontal bone of the skull.

4. The cap of claim 1 wherein the at least one protrusion is configured to be aligned with the coronal suture and further comprising a sagittal protrusion configured to be aligned with the sagittal suture.

5. The cap of claim 4 further comprising a lambdoid protrusion configured to be aligned with the lambdoid suture.

6. The cap of claim 1 wherein the at least one protrusion has a cross-section including a post connected to the crown and an engagement portion of broadened cross-section compared to the post.

7. The cap of claim 6 wherein the at least one protrusion further comprises a tip formed on the end of the engagement portion.

8. The cap of claim 1 further comprising a second protrusion that is configured to start at the supraorbital notch, extends up and then slopes laterally before extending toward the rear of the front bone.

9. The cap of claim 1 further comprising a frame attached to the cap, the frame being rigid to support the weight of a user's head.

10. A method of preventing hair loss comprising the steps of providing a cap which has a crown that defines a concave surface and the cap further having a protrusion attached to the concave surface and extending inwardly therefrom such that when the cap is placed on a user's skull the protrusion is configured to be aligned with a suture on the user's skull while all portions of the concave surface remote from said suture are free of anything extending from the concave surface and periodically abrading excess bone growth along the wherein the suture is at least one of a coronal suture, a sagittal suture and a lambdoid suture of the skull by rubbing the cap in the area immediately above the protrusion, wherein the suture is at least one of a coronal suture, a sagittal suture and a lambdoid suture.

11. A cap comprising a crown having a concave surface and at least one first protrusion extending inwardly from the concave surface, the at least one first protrusion being located such that when the cap is placed on a user's skull the at least one first protrusion is configured to extend from a first surpraorbital foramen upwardly and rearwardly along a first inferior temporal line of the user's skull, while all portions of the concave surface remote from said first inferior temporal line are free of anything extending from the concave surface.

12. The cap of claim 11 wherein the at least one first protrusion is configured to extend to a parietal foramen of the user's skull.

* * * * *